United States Patent [19]

Yates

[11] Patent Number: 5,063,949

[45] Date of Patent: Nov. 12, 1991

[54] APPARATUS FOR SPRAY RINSING CHEMICALLY TREATED ARTICLES

[76] Inventor: William Yates, 847 S. Sapphire La., Anaheim Hills, Calif. 92807

[21] Appl. No.: 525,998

[22] Filed: May 21, 1990

[51] Int. Cl.[5] ..... B08B 3/02

[52] U.S. Cl. ..... 134/60; 134/95; 134/98; 134/103

[58] Field of Search ..... 134/60; 95, 98, 103; 68/205 R

[56] References Cited

U.S. PATENT DOCUMENTS

| | | | |
|---|---|---|---|
| 2,471,506 | 5/1947 | Wiswall | 134/98 |
| 2,558,628 | 6/1951 | Redin | 134/95 |
| 2,745,418 | 5/1956 | Balcom et al. | 134/103 X |
| 2,963,029 | 12/1960 | Bock | 134/95 X |
| 3,945,388 | 3/1976 | Clark | 134/57 R |
| 4,409,999 | 10/1983 | Pedziwiatr | 134/95 |
| 4,654,089 | 3/1987 | Singelyn et al. | 134/26 |

OTHER PUBLICATIONS

Bill Yates, "Atmospheric Evaporators", Plating and Surface Finishing, Apr., 1986.

William Yates, "Leveraging Recovery", Products Finishing, Feb. 1988.

Bill Yates, "Natural Recovery", Finisher's Management, Mar. 1988.

William Yates, "Rinsing with Less Water", Metal Finishing, May 1989.

Joseph B. Kushner and Arthur S. Kushner, "Water and Waste Control for the Plating Shop", (2nd ed.).

A. Kenneth Graham, "Electroplating Engineering Handbook", (3rd ed.).

*Primary Examiner*—Philip R. Coe

*Attorney, Agent, or Firm*—Francis X. LoJacono

[57] ABSTRACT

A process and apparatus that includes multiple counterflow rinsing of chemically treated, anodized, plated or otherwise processed workpieces, utilizing a single on-line spray-rinse tank or station with successively less concentrated or contaminated rinse solutions that are sequentially pumped from one or more off-line tanks or reservoirs that provide at least three overlapping counterflow spray rinse cycles that cover the treated workpiece or workpieces which can be supported individually or together in a bulk processing barrel in the spray-rinse tank, whereby the workpiece or pieces are decontaminated for any additional processing of a finished part using a minimum amount of water or rinse solution during the rinsing process.

18 Claims, 3 Drawing Sheets

APPARATUS FOR SPRAY RINSING CHEMICALLY TREATED ARTICLES

BACKGROUND OF THE INVENTION

1. Field of the Invention

This invention relates generally to the rinsing or cleaning of surface-treated articles or workpieces, and more particularly to an environmental waste-control apparatus and process for counterflow spray rinsing of chemically treated, anodized, plated or otherwise processed workpieces, utilizing a single on-line rinse tank or station with successively less contaminated rinsing solutions that are stored in a plurality of off-line tanks.

2. Description of the Prior Art

As is well known in the art, various problems and difficulties are encountered in providing suitable and efficient water-rinsing means for rinsing or cleaning of chemically treated articles or workpieces. Rinsing of a workpiece is generally required after it has been chemically or similarly treated by one of several processes whereby the workpiece or article is cleaned to prevent staining or to prevent the contamination of any sequential processes that might be necessary. This rinsing is generally done by placing the treated parts in a tank of running water or rinse solution, or sequentially dipping the parts in several tanks. However, sprays using water-rinsing solutions have been utilized for a rinsing method wherein several rinse stations are sequentially employed. Sprays have also been utilized in combination with flooded rinse tanks.

The combination of rinsing, using both the flooded tanks and sprays, is advocated by H. L. Pinkerton and A. Kenneth Graham, in their chapter on rinsing in "Electroplating Engineering Handbook", third edition, edited by A. Kenneth Graham, 1971 (Library of Congress Catalog Card No. 75-12904), where they stated:

"Water Economy

Several means for achieving economy of water have already been mentioned:

(1) Multiple countercurrent rinsing.

(2) Spray rinsing.

(3) Spray-and-dip rinsing.

Additional water may be saved if sprays are fed by water pumped from a succeeding rinse tank."

Further, Joseph B. and Arthur S. Kushner state in their book "Water and Waste Control for the Plating Shop", dated 1972, on page 213:

"Engineering Appendix

TANK AND SPRAY COMBINATIONS

Where space is limited, tank and spray combinations offer many advantages. Indeed they offer advantages even where space is not limited. These combinations are excellent with most rack rinsing. They are not of much value in barrel rinsing.

The particular advantage of combining a spray with a tank is this: the spray can tremendously increase the rinsing efficiency as it may provide the equivalent of one or more additional rinse tanks! Consider the arrangement shown in FIG. (68). It is a single rinse tank with a double spray. The work leaving the plating is sprayed over the plating tank by the water exiting from the rinse tank. Now the work goes into the rinse tank for a soak rinse, then as it is lifted out it gets sprayed by the incoming clean water feed to the rinse tank. The sprays are activated only when work leaves the tanks."

U.S. Pat. No. 4,654,089 issued to Singelyn et al, dated Mar. 31, 1987, discloses a process and an apparatus for rinsing a chemically treated or plated article by sequentially moving the article initially over a chemical-solution bath and subsequently over a plurality of rinse baths, in which the article is sprayed as it rises from each successive bath with a less concentrated rinse solution from the next succeeding bath.

However, none of the above patents teaches that which is claimed herein.

Thus, it is important to note that the object of all the above is to provide an adequate job of rinsing by diluting the process residue left on the work to the point where it is no longer objectionable—with the least amount of water or rinsing solution.

To obtain a rinsing or dilution ratio of 10,000:1, where the production of one hour's processing carries over one gallon of residue into a rinsing tank, 10,000 gallons of water or rinsing solution flow is required over the same hour. To obtain the same 10,000:1 dilution ratio with two rinse tanks, where the rinsing solution is introduced into the second rinse tank—then overflowed to the first rinse tank—only 100 gallons of rinsing solution is required. This is because the dilution ratio is about 100:1 in each tank; therefore, $100:1 \times 100:1 = 10{,}000:1$. Carrying this principle further, three counterflowing rinses require 22 gallons, 4 rinses require only 10 gallons.

However, to conserve water or rinsing solution by using this technique, a plurality of immersion rinsing tanks and/or spray stations are required within the processing sequence. Utilizing the space for rinse tanks is often costly; and in the case of automated process lines designed before water conservation became a concern, such space is non-existent.

It should be noted that the instant invention is an improvement over the pending application Ser. No. 07/238,107; filed: Aug. 30, 1988; titled: "Apparatus For Multiple Spray Rinsing Of Workpieces In A Single Station," by the present inventor.

In U.S. Pat. No. 3,945,388 issued to Chester Clark, three spray rinses are provided from three reservoirs. The counterflowing of the rinse solution in this invention is directly from one reservoir to the next.

In contrast, however, the present invention includes the step of using a first short spray-rinse in turn from each reservoir to:

a. move any solution remaining in the pipes and pumps of the system to a lower numbered, more contaminated reservoir;

b. cause the counterflowing from a higher numbered reservoir to a lower number reservoir; and c. further dilute the residue on the articles being rinsed. (Each reservoir is used twice.) A three reservoir system will produce seven rinses.

OTHER PUBLICATIONS

1. Yates, Bill, "Atmospheric Evaporators", Plating and Surface Finishing, April, 1986.

2. Yates, William, "Leveraging Recovery", Products Finishing, February, 1988.

3. Yates, Bill, "Natural Recovery", Finisher's Management, March, 1988.

4. Yates, William, "Rinsing With Less Water", Metal Finishing, May 1989.

SUMMARY AND OBJECTS OF THE INVENTION

It is an important object of this invention to provide any number of counterflowing spray rinses using the space in a processing line assigned to a single rinse tank.

This is accomplished by installing spray nozzles and associated piping around the rim and/or inside an empty rinse tank in the processing line that has a bottom-drain fitting.

When a processed workpiece or articles is placed in this rinse tank, a small amount of water or rinse solution is pumped (first spray) from a small off-line tank (reservoir #1) to the spray nozzle assembly. This rinse solution impinges on the articles, and drops to the bottom of the rinse tank, and is then pumped elsewhere, either to a discard station, drain waste, or to the process tank to compensate for evaporative losses. After most of this solution has been discharged, a second spray from reservoir #1 is used to rinse the articles, this rinse solution being circulated back to reservoir #1.

Next, a first short spray from a second off-line tank (reservoir #2) is provided to dilute the residue on the processed articles, the rinse solution being pumped back to reservoir #1. After a short wait, a second spray from reservoir #2 is employed to rinse the articles, the rinse solution being circulated back to reservoir #2. Then, a short spraying from the third off-line tank (reservoir #3) is used. This is returned to reservoir #2. After a short wait, another spraying from reservoir #3 is used and returned to reservoir #3. Following the last spraying from reservoir #3, a final spray is provided by using a fresh solution source, preferably fresh city water. Once sprayed, this fresh water is pumped to reservoir #3, which stores the least contaminated solution.

In the equipment layout for the above description, three reservoirs are used and various pump and/or automatic valve combinations can be employed. The rinsing equipment and operating sequences will hereinafter be described as including two air-operated diaphragm pumps and eight air-operated valves.

However, it should be further understood that any number of reservoirs can be employed, even though only three reservoirs are shown and disclosed herein. With the use of three reservoirs, the end result is that seven separate sprays are accomplished in each complete rinse cycle, and each spray is progressively cleaner (less contaminated) than the preceding spray.

As an example, if 10 gallons of counterflowing rinse solution are used for each gallon of process solution residue, the resulting dilution would exceed 10,000,000:1

$(10\times10\times10\times10\times10\times10\times10=10{,}000{,}000)$.

Accordingly, it is still another important object of the present invention to use only 10 gallons of rinse solution of water for every gallon of contaminated residue that is to be removed from a workpiece.

Yet, another object of the present invention to provide a process and apparatus that rinses chemically or otherwise treated articles within a single rinse tank or station using the counterflowing principles of spraying the articles with progressively cleaner (less contaminated) rinse solution without moving the workpiece or articles being processed from one tank to another.

Still another object of the invention is to provide a safe environmental waste-control apparatus and method thereof that uses a first short spray, in turn, from each off-line reservoir to:

1. move any solution remaining in the pipes and pumps of the apparatus to a lower numbered, more contaminated reservoir;

2. cause the counterflowing of solution from a higher numbered reservoir to a lower numbered reservoir; and 3. further, dilute the residue on the articles being rinsed, with the solution from each reservoir being used twice, whereby three reservoirs produce a seven-spray rinse system.

Another object of the invention is to provide an apparatus and process of this character to accomplish the rinse spraying of treated articles in a single rinse tank or station, with rinse solution being pumped and recirculated from off-line reservoirs for a predetermined time and in an overlapping sequence from one reservoir to another; and wherein the process is compatible with the rinsing of a single workpiece or a multiplicity of workpieces or articles that are supported in a horizontal, perforated, rotatable barrel for bulk processing.

A further object of the present invention is to provide an apparatus of this character having one or more off-line reservoirs, the following being an example of using three reservoirs that provides seven counterflow spray cycles, A first small portion of the rinse solution from the first off-line reservoir is sprayed on an article positioned in the rinse tank with the rinse solution thereof being discharged from the rinse tank as contaminated waste solution. A second rinse from the first reservoir is then pumped and sprayed over the article and returned back to the first reservoir, and thereafter a second off-line reservoir is then substituted for the first reservoir, with the first portion of the second solution from the second reservoir being sprayed on the article and returned from the rinse tank to the first reservoir. After a predetermined time, a third off-line reservoir replaces the second reservoir, with the first spray portion of the third rinse solution being sprayed and then pumped to the second reservoir, wherein the remaining spray of the third solution is returned to the third reservoir followed by a short spray of fresh water or fresh solution, which is circulated back to the third reservoir, and thereafter a given amount of solution from the first reservoir is pumped to fill the pipeline for the next spray sequence for processing another article. The solution that remains in the pipeline is referred to a "push" water or rinse and is purged from the line prior to the subsequent cycle.

A still further object of the invention is to provide an apparatus of this character wherein the application of power and timing of the pumps, valves or other alternative devices is accomplished by a sequential multiple timing device that receives its starting signal each time a new article or a set of articles is placed into the rinse tank or station.

Another object of the present invention is to provide a process of this character that will produce a clean workpiece with as minimal amount of solution as possible.

And still a further object of the present invention is to provide a process that can be arranged for a particular rinse system where one or more reservoirs may be employed, and wherein a given number of reservoirs used will provide a given number of counterflow spray cycles. The ratio of counterflow spray rinse cycles is determined by the number of reservoirs times two plus one.

One reservoir=3 counterflow spray cycles
Two reservoirs=5 counterflow spray cycles
Three reservoirs=7 counterflow spray cycles The various features of novelty which characterize the invention are pointed out with particularity in the claims annexed to and forming a part of this disclosure. For a better understanding of the invention, its operating advantages by its use, reference should be had to the accompanying drawings and descriptive matter in which there are illustrated and described the preferred embodiments of the invention.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
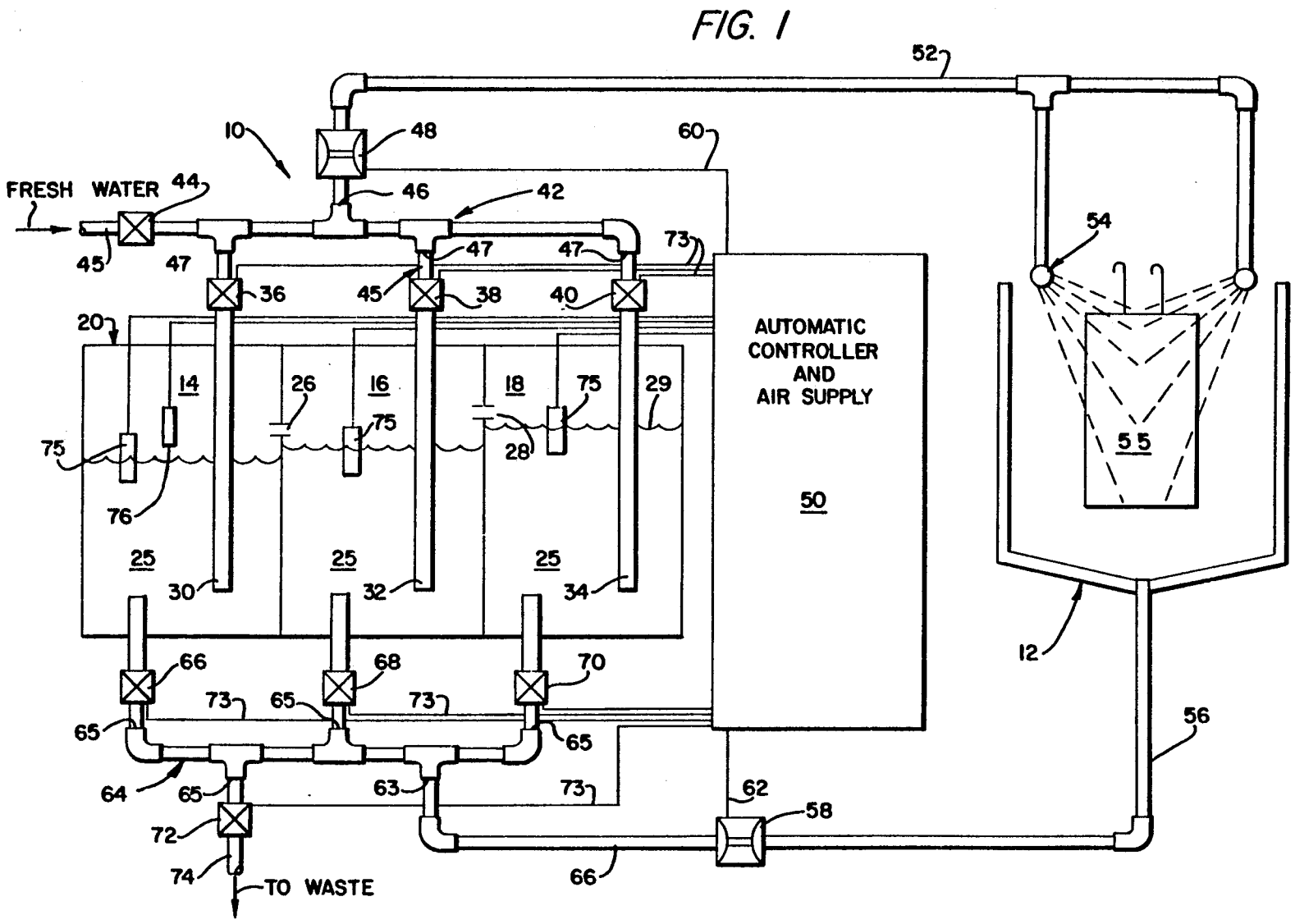
FIG. 1 is a diagrammatic view of the present invention illustrating, in combination, the solution flow system of the rinsing process together with the electrical system employed for sequential operation of the apparatus.

Referring more particularly to FIG. 1, there is illustrated an apparatus, generally indicated at 10, that includes a new method of a a fluid-circulating system for multiple counterflow rinsing of chemically treated articles or workpieces, which provides a spray tank or station, designated at 12, and three reservoirs 14, 16, and 18 that are shown formed in a single unit, indicated generally at 20.

Although, three reservoirs are shown and described herein it should be well understood that any number of reservoirs may be suitably employed so as to correspond to a particular counterflow rinse system. That is, several reservoirs may be added or subtracted as need be.

Accordingly, the following description of the present invention will hereinafter describe the preferred embodiment using three reservoirs 14, 16, and 18 in which water or a selective type of rinse solution is stored for operating the process of the present invention. For simplicity, cost, and as a space saver, reservoirs 14, 16, and 18 are shown formed as a single unit 20 having a pair of inner walls 22 and 24. However, each reservoir may be made as an individual tank, when required. Each storage tank or reservoir is provided with a different strength of rinse solution 25. Hence, each successive tank or reservoir 14, 16, and 18 holds progressively cleaner or less contaminated rinse solution 24. Due to the sequential arrangement and steps of the process, which will hereinafter be described in more detail, the degree of contamination of the rinse solution in each reservoir will remain substantially the same throughout the rinsing operation. Preferably, in order to save space, reservoirs 14, 16 and 18 are positioned in a contiguous arrangement whereby reservoir 18 communicates with reservoir 16, and reservoir 16 communicates with reservoir 14. The communication means is defined by overflow pipe connectors 26 and 28 mounted in respective walls 26 and 28, with overflow pipe connector 26 being located sequentially lower than pipe connector 28, and both connectors being positioned above operating waterline 29 of the reservoirs, as seen in FIG. 1. This allows for diluted rinse solution to flow from each succeeding reservoir as needed. Accordingly, the most diluted rinse solution is stored in reservoir 18, and the most contaminated rinse solution is stored in reservoir 14.

Each reservoir is provided with a discharge-flow outlet pipe; that is, reservoir 14 is provided with discharge pipe 30, reservoir 16 with discharge pipe 32, and reservoir 18 is provided with discharge pipe 34. Pipes 30, 32 and 34 are each connected to a valve means 36, 38 and 40, respectively. The valve means may be of any suitable type, but is preferably a pneumatically operated one such as a double-acting pneumatic valve produced by Ryan Herco. Valve means 36, 38 and 40 will hereinafter be referred to as discharge valves since they are disposed between their respective discharge pipes and inlet ports of a discharge manifold, designated generally at 42. A fourth valve 44 is connected to manifold 42 along with the discharge valves. Valve 44 is a fresh water valve and is connected to any suitable fresh water line 45.

Connected to the outlet port 46 of manifold 42 is a spray pump means 48. This pump may be of any suitable type such as an air-powered, double-diaphragm, Marathon ball valve MP04P pump. Thus, it is to be noted that the pumps and valves herein disclosed are of an air-operated type that are operably connected to an air supply means, which also includes an automatic control and air supply means, generally indicated at 50. Pump means 48 is located in discharge pipeline 52 which is provided at its far end with a plurality of spray means, indicate at 54, and positioned over rinse tank 12 so as to spray solution 25 over a workpiece 55, as illustrated in FIG. 1.

Accordingly, solution 25 is drained into an outlet system which includes outlet pipe 56 connected to a second pump means 58. Both pumps 48 and 58 are operated by air supply means 50 through air lines 60 and 62, respectively. Pump 58 is further connected to the inlet port 63 of a return manifold 64 by means of return pipe 66. Attached to the outlet ports 65 of manifold 64 are four additional return valves 66, 68, 70 and 72. Valve 66 is positioned between manifold 64 and reservoir 14; valve 68 is located between manifold 64 and reservoir 16; and valve 70 is positioned between manifold 64 and reservoir 18.

Valve 72 is directed to waste, or to a process tank (not shown) to compensate for evaporation losses. Again, all valves are operated by the automatic controller means and air supply means 50, and are connected thereto by air supply lines 73.

OPERATION OF THE PROCESS

The following description of the present invention discloses the employment of three reservoirs. However, the process can readily be practiced with any number of reservoirs that would be compatible to a particular process. As examples, a single reservoir or tank provides three counterflow sprays, two reservoirs provide five counterflow sprays, three reservoirs provide seven counterflow sprays, etc.

Figure 2:
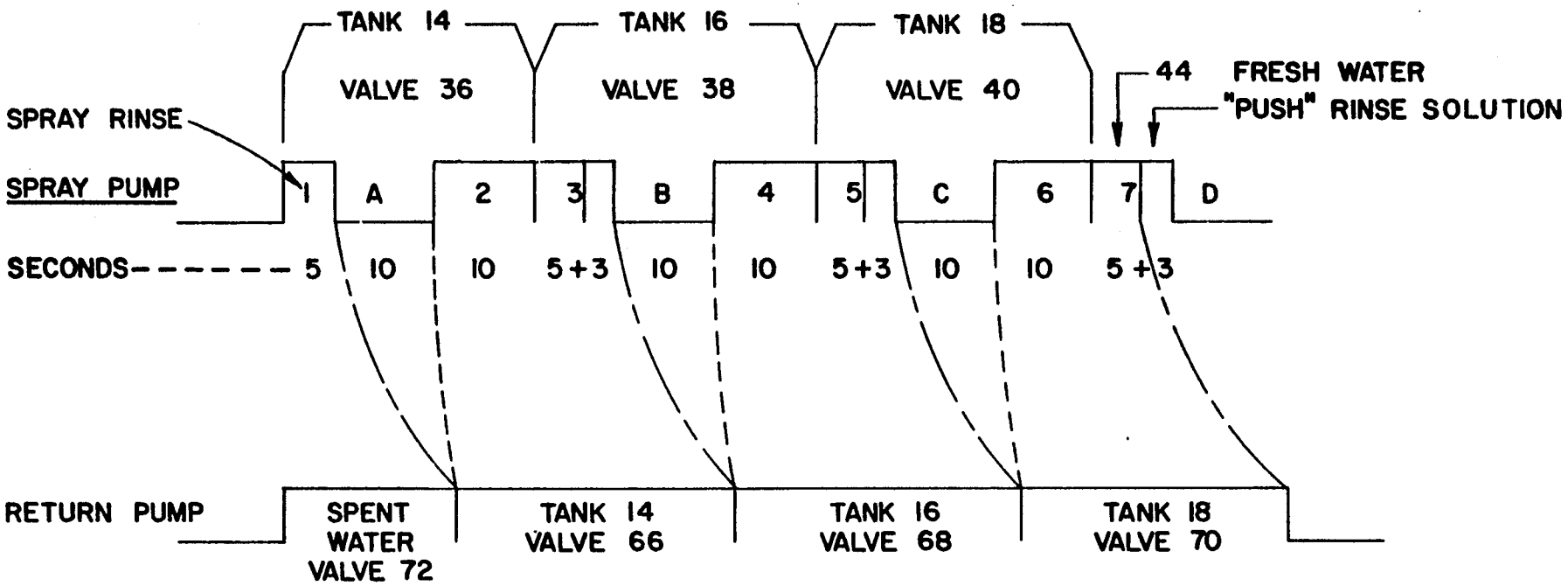
FIG. 2 is an operational chart of the pump and valve programming of the sequential circulating counterflow system.

FIGS. 1 and 2 should be referred to during the reading of the following operational description. The valve operational chart of FIG. 2 includes an upper indicating the spray pump operation 48 and the lower second line indicates the spray pump operation 58. The upper line includes the "on" and "off" timing of valves 36, 38, 40, and fresh water valve 44 with respect to the operation of the three reservoirs and the seven spray-rinse cycles. The broken lines defines the flow of solution between the three tanks 14, 16 and 18 with respect to the valve operation and the seven spray-rinse cycles.

Each time a rinsing process begins, a first (1) spray-rinse cycle starts with solution 25 being pumped from reservoir 14 for five seconds by way of outlet pipe 30. Reservoir 14 has the highest contaminated solution stored within the three tanks. This solution is drawn and pumped through valve 36 by means of pump 48, and is sprayed by spray means 54 for 5 seconds over workpiece 55 which is positioned in rinse tank 12. It is important to note at this time that this spray rinsing process also allows for a multiplicity of workpieces or articles to be spray-rinsed when the workpieces or articles are supported in a plating or process barrel that is adapted to be received in spray-rinse tank 12. Solution from rinse tank 12 is then drained (drain cycle A) and pumped by pump 58 through manifold 64, and discharged through open valve 72 as spent solution through outlet line 74 for 10 seconds. It should be understood that at this time all of the other valves are in a closed mode. The spent solution will contain almost all of the residue rinsed off the processed workpiece 55; thus it is either sent to waste or back to the process tank, as mentioned above for a highly contaminated solution.

Drain cycle A occurs between the first (1) spray rinse and the second (2) spray rinse. This is referred to as a ten second "OFF" time. That is, valve 36 is closed down until all of the solution for the first spray rinse is drained from rinse tank 12 before valve 38 is opened. The first ten second "OFF" time (See chart of FIG. 2 at A.) allows enough time for the sprayed solution to be emptied from the spray-rinse tank 12. A second spray-rinse cycle begins and sprays workpiece 55 again, but this time valve 72 is closed and valves 36 and 66 are now open, allowing the solution from reservoir 14 to return back to reservoir 14. Valve 36 is at this time placed in an open mode for ten seconds which is indicated at (2) in FIG. 2. Then valve 36 is closed to start the third (3) spray rinse cycle with valve 38 being opened for eight seconds (5+3), the last three seconds remaining in the outlet pipes 42, 46 and 52. This allows the first five seconds of solution 25 from reservoir 16 to be returned to reservoir or tank 14. Then the third (3) rinse cycle is closed down; that is, valve 38 is closed (See B in FIG. 2.) for ten seconds allowing solution 25 to be drained from rinse tank 12. Valve 38 is then returned to an open mode for ten seconds. At the same time valve 68 is opened to start a fourth (4) spray-rinse cycle, whereby solution from tank 16 is returned back to tank 16. When valve 38 is closed, valve 40 is opened for eight seconds (5+3), allowing solution from tank 18 to flow through spray means 54 for a fifth (5) spray rinse into tank 16. Valve 40 is closed down for a third drain cycle C, allowing solution from rinse tank 12 to completely drain into reservoir 18, again allowing the last three seconds of solution to remain in the pipes between valve 40 and spray means 54.

A sixth (6) spray rinse cycle is started when valve 40 is reopened along with the closing of valve 68 and the opening of valve 70 connected to tank or reservoir 18. Accordingly, solution from tank or reservoir 18 is recycled back to reservoir 18 preceded by the left-over three seconds of solution from tank 16. Again, valve 40 is in an open position for ten seconds and then valve 40 is closed to start the seventh (7) rinse cycle. For the seventh and final rinse cycle of the process, fresh water valve 44 is opened, allowing fresh water to be pumped through spray means 54 whereby fresh water is sprayed over the workpiece or bulk articles supported in a plating barrel. This rinse is timed for five seconds and is then closed down. However, it is important to note that following the closure of valve 44, valve 36 of reservoir 14 is again opened for three seconds. This is done in order to provide three seconds of solution from tank 14 to fill the intervening pipe between valve 36 and spray means 54 so as to provide a "push" rinse for the beginning of the following rinse process of another workpiece. All of the valves in the system close prior to the starting of another complete rinsing process. This is indicated at D in the operational chart of FIG. 2.

Thus, it should be noted that prior to each second of drain cycle (A, B, C and D) there are three seconds of solution remaining in the manifold and pipes interposed between the respective valves 36, 38, and 40, and the spray means 54. The average piping length between the spray valves and the spray nozzles is such that it will always contain approximately three seconds of pumped solution.

However, another method of "pushing" the solution would be to inject compressed air in the delivery or discharge pipeline 52.

Even if the valve programming is done symmetrically, one or more of the reservoir fluid levels may change for any number of reasons. To correct this condition, float switches 75 are employed in each reservoir to detect a low level condition. A low level detected in any reservoir is automatically corrected by increasing the "on" time for valve 44, causing fresh water or rinse solution to enter reservoir 18 and to correct the condition directly. If a low level is indicated in either reservoir 14 or 16, solution from reservoir 18 will eventually flow through the inter-reservoir opening 28 and possibly through opening 26.

If a high level is detected in reservoir 14 by float switch 76, the "on" time for the first spray through valve 36 is increased. This removes more than the normal volume of solution through valve 72 and reduces the level of solution in reservoir 14.

Figure 3:
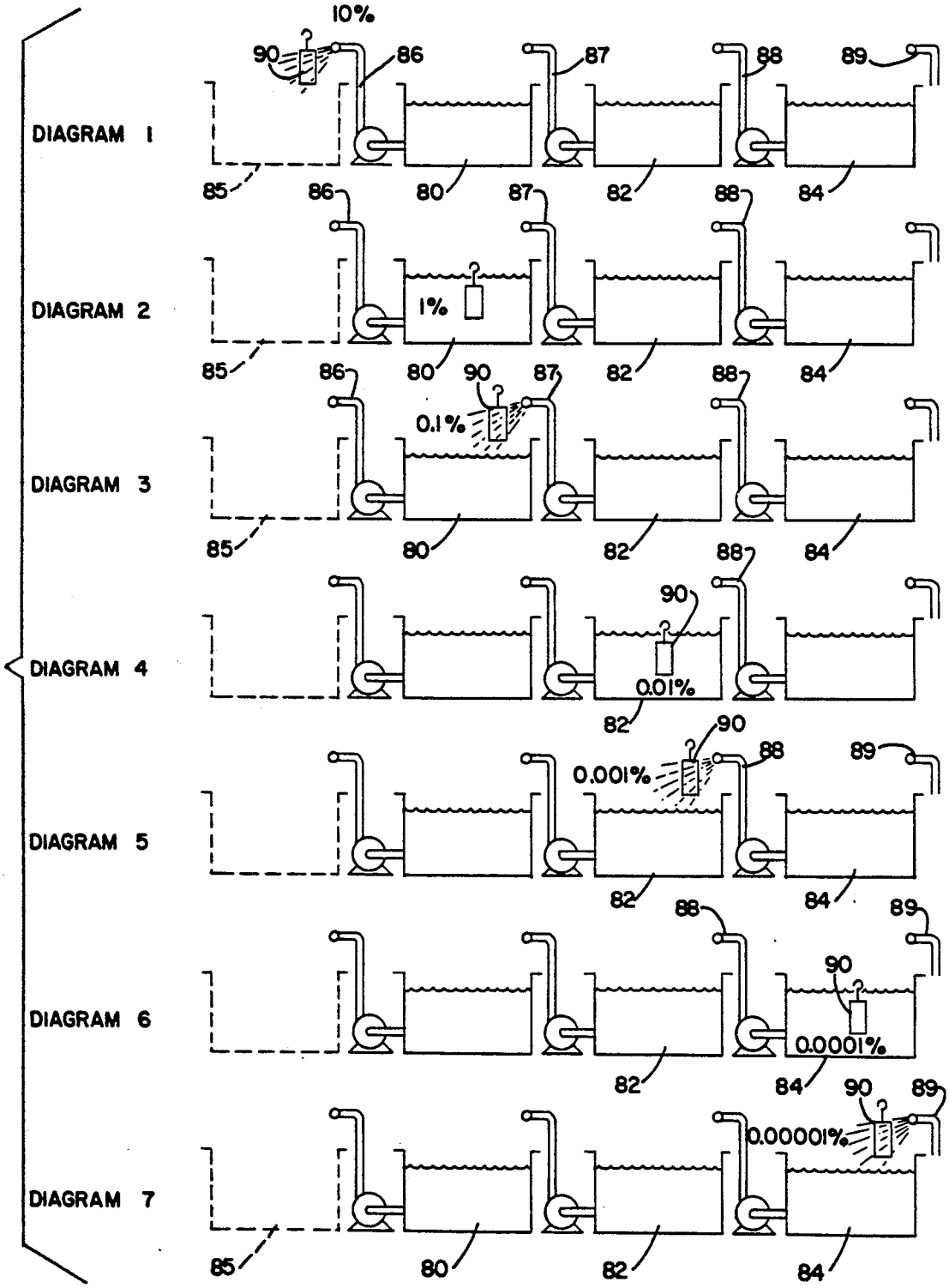
FIG. 3 is a chart illustrating 1 through 7 diagrams as a comparative example of a counterflow seven-rinse system using a process tank, three rinse tanks, and three spray nozzles.

Referring now to FIG. 3, there is illustrated a chart having seven sequential rinse diagrams showing three separate rinse tanks 80, 82 and 84. Each rinse tank is provided with a spray means located at the head of the respective tanks. In each diagram a process tank 85 is shown in dotted lines, followed by the first spray means 86 operably connected to first rinse tank 80. A second spray means 87 is interposed between tanks 80 and 82, with a third spray means 88 located between tanks 82 and 84, and a fourth spray means 89 being located behind rinse tank 84. This process uses a 10:1 (water to residue) counterflow operation.

Diagram 1 shows a workpiece 90 being sprayed over process tank 85 with solution from rinse tank 80, the residue on this workpiece being reduced to 10% concentration after the first spray.

Diagram 2 shows workpiece 90 dipped into the solution of a first tank 80. This reduces the concentration of the residue on the workpiece to 1%.

In diagram 3, workpiece 90 is removed from the solution and is sprayed by second spray means 87 with solution from a rinse tank 82, which further reduces the residue on workpiece 90 to 0.1%.

In diagram 4, workpiece 90 is dipped into the solution of the second rinse tank 82 and reduces the residue to 0.01%.

In diagram 5, workpiece 90 is raised above tank 82 and is sprayed by means 88 with solution from a rinse tank 84. The residue on workpiece 90 is then reduced to 0.001%.

As seen in diagram 6, workpiece 90 is then dipped into the third tank 84 thereby reducing the residue thereon to 0.0001%.

Diagram 7 shows the work positioned over the last tank 84 with the workpiece being sprayed with fresh water from spray means 89 which reduces the residue thereon to 0.00001%.

Accordingly, the seven-step diagrams correspond to the seven rinse cycles as described above in FIGS. 1 and 2.

The prior art defines counterflowing rinses as 2 or more rinse tanks that are connected so that water or other cleaning solution introduced into the last rinse flows counter to the flow of work into the previous rinse tank, etc. The advantage of this arrangement is that each rinse station provides a dilution ratio approximately equal to the ratio of rinse-solution flow to the volume of dilutable residue on the work to be cleaned over a given time period.

When a pump and spraying system is attached to one tank in a counterflowing series of tanks, and the spray is directed to the work suspended over this same tank, the pump merely circulates the same water over and over. The residue on any work in the path of this spray cannot be diluted any further than the concentration already present in that rinse solution. This is the situation that occurs in the present invention's rinses 2, 4 and 6. The solution will be the same as if the work is immersed in the flooded tank. The amount of solution that can be sprayed in rinses 2, 4, and 6 is limited by only the size of the delivery system and the time available. However, the maximum dilution of the residue possible is limited to the concentration of this recirculated spray. In the example where there is 10 times the rinse-solution flow per quantity of residue, these rinses can produce about a 10:1 dilution, reducing the concentration of the residue to 10% each time one of these rinses is used.

The amount of solution that can be sprayed in rinses 1, 3, 5 and 7 is limited to the amount of solution we are willing to discard, counterflow, and introduce during each complete rinse cycle. But, the dilution ratios can be much higher than seen in the "recirculating" spray. This is explained by visualizing what happens when a given quantity of residue is impacted with the same quantity of clean rinse solution. Because of dilution and displacement the parts or workpiece will hold only a given quantity of solution. The dilution ratio can be 2.72:1 for each equal quantity of solution impacting the work. Continuing with the 10:1 (water to residue) example, the total dilution possible here is 2.72 to the tenth power:1 or 22166:1.

However, it does not work quite that well in the real world. To start with, we could be pessimistic and say that only ½ of the spray solution impinges on the parts, and the rest of the spray is wasted. This would result in the lower dilution ratio of 2.72 to the fifth power:1 or 148:1. If the spray were only 23% effective, it would result in 10:1 dilution.

Using the above pessimistic figure of 10:1 dilution in all seven sprays in the present invention results in a total residue dilution of 10 to the seventh power:1 or 10,000,000:1. Mr. Clark's three rinse reservoirs produce 10 to the third power: 1 or 1000:1 with the same counterflow water rate. Another way to compare: this invention requires 7.2 gallons of counterflow solution to realize a 1,000,000:1 dilution per gallon of residue, whereas the Clark invention requires 100 gallons for the same results.

The foregoing is a description of the embodiments of the invention which is given here by way of example only. The invention is not to be taken as limited to any of the specific features as described, but comprehends all such variations thereof as come within the scope of the appended claims.

What I claim is:

1. An apparatus for rinsing chemically treated workpieces, comprising:

a plurality of reservoirs wherein a rinse solution is stored;

a single spray-rinse tank connected so as to communicate with said reservoirs to receive said rinse solution from each of said reservoirs for spray-rinsing the workpiece positioned within said spray-rinse tank;

means positioned with said spray-rinse tank for spraying said workpiece;

a first flow means for discharging the rinse solution from said reservoirs to said spray-rinse tank in a selective "on" and "off" overlapping sequential operation;

a second flow means for returning the rinse solution from said spray-rinse tank back to said reservoirs in an overlapping sequential operation;

means for operating said first and second flow means; and means for automatically controlling the sequential operation of said first and second flow means.

2. The apparatus as recited in claim 1, wherein said first flow means for discharging the rinse solution comprises:

a plurality of discharge valves, each of said discharge valves being operably connected with said respective reservoirs and said spray means; and wherein one of said discharge valves includes a fresh water valve operably connected to said spray means and positioned in-line with said other discharge valves, said fresh water valve being connected to a water supply means; and a pump means connected to said discharge valves, said fresh water valve and said spray means, whereby said solution and said fresh water are pumped from said reservoirs and said water supply means respectively for spraying a workpiece mounted in said spray tank in a sequential overlapping order, wherein said solution in said reservoirs is progressively diluted for the sequential spraying of the workpiece to be cleaned followed by a final spray rinse of the fresh water from said water supply means.

3. The apparatus as recited in claim 2, wherein said second flow means for returning the rinse solution back to said reservoirs comprises:

a plurality of return valves being connected to a drain means, to the respective reservoirs and to said spray rinse tank; and a return pump means interposed between said return valves and said spray-rinse tank, whereby said rinse solution is pumped from said spray-rinse tank and sequentially returned to said drain means and to designated reservoirs during a given rinse cycle.

4. The apparatus as recited in claim 3, wherein said discharge valves and said return valves are defined as pneumatic valves, and said discharge pump and said return pump are defined as pneumatic pumps.

5. The apparatus as recited in claim 4, wherein said means for operating said first and second flow means comprises an air pressure supply means connected to said pneumatic valves and to said pneumatic pumps, and wherein said automatic control means is connected to said pneumatic valves and to said pneumatic pumps, whereby said pneumatic valves and said pneumatic pumps are selectively and sequentially operated to define a multiplicity of overlapping counterflow spray-rinse cycles.

6. The apparatus as recited in claim 5, wherein said first flow means includes:

a discharge manifold having a plurality of inlet ports and an outlet port; and a plurality of discharge pipes positioned in respective reservoirs and connected to said inlet ports, said discharge valves being interposed between said inlet ports and said discharge pipes, wherein said fresh water valve is connected to one of said inlet ports of said manifold, and wherein said discharge pump is interposed between said outlet port of said manifold and said spray means.

7. The apparatus as recited in claim 6, wherein said second flow means includes:

a return manifold having an inlet port and a plurality of outlet ports;

a plurality of return pipes positioned in respective reservoirs and connected to said outlet ports, said return valves being interposed between said return pipes and said outlet ports;

a drain valve connected to one of said outlet ports; and wherein said return pump is interposed between said inlet port and said spray rinse tank.

8. The apparatus as recited in claim 7, wherein said apparatus is formed having two reservoirs and three counterflow spray-rinse cycles.

9. The apparatus as recited in claim 7, wherein said apparatus is formed having three reservoirs and seven counterflow spray-rinse cycles.

10. The apparatus as recited in claim 7, wherein said apparatus includes means for controlling the level of rinse solution in each of said reservoirs.

11. The apparatus as recited in claim 10, wherein the rinse solution consists of water.

12. The apparatus as recited in claim 10, wherein the rinse solution consists of a chemical compound solution.

13. An apparatus for spray-rinsing a chemically treated workpiece or articles supported in a bulk processing barrel using a single spray rinse station, wherein the least amount of rinse solution is used in diluting the residue left on the treated workpiece, said apparatus comprising:

a least one spray-rinse tank defining a spray station having a spray assembly mounted on said rinse tank, said rinse tank and said spray assembly being formed to receive a workpiece therein, wherein a rinse solution is sprayed over the workpiece;

a plurality of reservoirs having sequentially less contaminated rinse solution stored in each of said reservoirs;

a counterflow means having a discharge flow system including a plurality of rinse cycles and a return flow system, said discharge flow system being attached to said spray-rinse tank whereby rinse solution is sprayed in sequential overlapping cycles from each reservoir into said spray tank, and wherein said return flow system communicates between said spray-rinse tank and each of said reservoirs, whereby rinse solution from said spray-rinse tank is returned sequentially to each reservoir in a corresponding overlapping response to the discharging of rinse solution from said reservoirs;

means for supplying fresh rinse solution to a last reservoir having the least contaminated solution stored therein, so as to define a final clean rinse cycle;

means for controlling and operating the sequential operation of said discharge flow system and said return flow system.

14. An apparatus as recited in claim 13 wherein each of said reservoirs is interconnected to the adjacent reservoir by means of passages, whereby the overflow rinse solution is transferable from one reservoir to an adjacent reservoir.

15. An apparatus as recited in claim 14, wherein said discharge system includes:

a plurality of discharge valves operably connected in sequence so as to communicate with respective reservoirs and said spray assembly; and a discharge pump interposed between said discharge valves and said spray assembly, and wherein said discharge valves and said discharge pump are operably connected to said control and operating means.

16. An apparatus as recited in claim 15, wherein said return system includes:

a plurality of return valves operably connected in sequence so as to communicate with respective reservoirs and said spray-rinse tank; and a return pump interposed between said return valves and said spray-rinse tank, and wherein said return valves and said return pump are operably connected to said control and operating means.

17. An apparatus for rinsing chemically treated workpieces, comprising:

at least one reservoir wherein a rinse solution is stored;

a single spray-rinse tank connected so as to communicate with said reservoir to receive said rinse solution from said reservoir for spray-rinsing the workpiece positioned within said spray-rinse tank;

means positioned with said spray-rinse tank for spraying said workpiece;

a first flow means for discharging the rinse solution from said reservoir to said spray-rinse tank in a selective "on" and "off" overlapping sequential operation;

a second flow means for returning the rinse solution from said spray-rinse tank back to said reservoir in an overlapping sequential operation;

means for operating said first and second flow means; and means for automatically controlling the sequential operation of said first and second flow means so as to provide at least three counterflow spray-rinse cycles.

18. The apparatus as recited in claim 17, wherein the number of counterflow spray-rinse cycles is determined by the number of reservoirs times two plus one.

* * * * *